US005583489A

United States Patent [19]

Loemker et al.

[11] Patent Number: 5,583,489

[45] Date of Patent: Dec. 10, 1996

[54] FABRIC SECURITY LABEL

[75] Inventors: Thomas R. Loemker, Fairfield, Conn.; Raymond A. Blanchard, Jr., Dryden, N.Y.; Gerald R. Bradley, Athens, Pa.; John R. Wilhovsky, Sparta, N.J.; Paul A. Chamandy, Ithaca, N.Y.

[73] Assignee: Paxar Corporation, Sayre, Pa.

[21] Appl. No.: 598,145

[22] Filed: Feb. 7, 1996

Related U.S. Application Data

[63] Continuation of Ser. No. 259,300, Jun. 13, 1994, abandoned.

[51] Int. Cl.[6] ..... G08B 13/14

[52] U.S. Cl. ..... 340/572; 235/487

[58] Field of Search ..... 340/572, 551; 235/487, 489, 493; 283/72, 74, 81, 98, 100, 105, 106; 40/625, 631; 428/43, 224

[56] References Cited

U.S. PATENT DOCUMENTS

| | | | |
|---|---|---|---|
| 3,493,955 | 2/1970 | Minasy | 340/572 |
| 3,780,368 | 12/1973 | Northeved et al. | 340/572 X |
| 4,075,618 | 2/1978 | Montean | 340/572 |
| 4,151,405 | 4/1979 | Peterson | 340/572 X |
| 4,510,490 | 4/1985 | Anderson, III et al. | 340/572 |
| 4,581,524 | 4/1986 | Hoekman et al. | 235/493 |
| 4,626,311 | 12/1986 | Taylor | 156/308.2 |
| 4,686,154 | 8/1987 | Mejia | 340/551 X |
| 4,766,301 | 8/1988 | Evers | 235/487 |
| 4,774,504 | 9/1988 | Hartings | 340/572 |
| 4,800,369 | 1/1989 | Goml et al. | 340/572 |
| 4,875,238 | 10/1989 | Solomon et al. | 2/115 |
| 5,012,225 | 4/1991 | Gill | 340/572 |
| 5,047,750 | 9/1991 | Hector | 340/573 |
| 5,079,541 | 1/1992 | Moody | 340/573 |
| 5,306,552 | 4/1994 | Shimizu | 340/551 X |
| 5,410,138 | 4/1995 | Martin | 235/487 X |
| 5,423,139 | 6/1995 | Feldman | 283/105 X |

FOREIGN PATENT DOCUMENTS

| | | | |
|---|---|---|---|
| 0096182 | 12/1983 | European Pat. Off. . | |
| 0123557 | 10/1984 | European Pat. Off. . | |
| 2513185 | 10/1976 | Germany | 235/493 |
| 1129761 | 10/1968 | United Kingdom . | |
| 2105952 | 3/1983 | United Kingdom . | |
| 29503 | 12/1994 | WIPO . | |
| 04853 | 2/1995 | WIPO . | |

*Primary Examiner*—Thomas Mullen
*Attorney, Agent, or Firm*—Barnard, Brown & Michaels

[57] ABSTRACT

A security label is attached to a fabric material for producing a signal when passed through a magnetic sensing field to produce a signal as an anti theft device for retail stores. The security label including a security device, such as a metallic strip, is attached to garments, apparel, soft goods (towels, etc.) and footwear (sneakers, etc.). The methods for attaching the security labels to the fabric materials include allowing convenient removal of the security device after the sales transaction and include permanent attachment. The security labels are attached to woven, coated, and synthetic fabrics by conventional sewing, heat sealing and/or ultrasonic sealing.

19 Claims, 15 Drawing Sheets

FABRIC SECURITY LABEL

This is a continuation of application Ser. No. 08,259,300, filed Jun. 13, 1994, now abandoned.

BACKGROUND OF THE INVENTION

1. Field of the Invention

The present invention relates generally to security labels for attaching to fabric materials and more particularly to security devices attached to garments and soft goods to reduce theft at retail stores.

2. Description of the Prior Art

A common problem at retail stores is the theft of garments and soft goods. This theft problem has been reduced by retail stores attaching relatively large and bulky plastic containing security devices to wearing apparel. These anti-theft devices usually pinched fabric material between two tightly connected parts that are very difficult to separate. These devices cause an audible signal when passed through a sensing field, usually magnetic, radio frequency or acustomagnetic, if the device is not removed from the garment where the sales transaction occurs.

The disadvantages of this type of anti-theft device are that it is bulky and makes it difficult to try on certain garments (i.e. intimate apparel); it is put on in retail stores by clerks whose main duty is serving customers, leading to inconsistent attachment and some unprotected items; and it takes time and expense to attach and detach to an item.

A U.S. Pat. No. 4,626,311 discloses an anti-theft device attached to a cloth product. The method of attaching the anti-theft device is by fusion.

A significant disadvantage of this anti-theft device is that this device does not provide an option of being able to remove the device after the sales transaction without causing substantial damage to the cloth product. With some cloth products, such as intimate apparel, this anti-theft device could be irritating or annoying to the user.

A U.S. Pat. No. 4,151,405 discloses an anti-theft system having a magnetic sensing field for detecting a security device when the security device passes through an interrogation zone of the anti-theft system to produce a detectable signal.

SUMMARY OF THE INVENTION

The purpose of the present invention is to provide a security label as an anti-theft device for garments and soft goods having the capability of being attached to garments during their manufacture assuring that all items to be protected have the security device securely attached frequently in a seam at a low additional cost, or is incorporated in an existing label, at no additional cost and having the capability of optionally being conveniently removed from the garments and soft goods without damaging the garments and soft goods.

The security label is made from a fabric material. A security device, such as a metallic strip, is attached to the fabric material by heat sealing. The security label is capable of interrupting a magnetic sensing field when the security label passes through the magnetic sensing field to produce a signal indicating to an employee at a retail store that an item may not have been paid for, thereby deterring and reducing theft.

The invention includes two main embodiments. The first main embodiment is providing a security label which has only a security device and is attached to garments and soft goods separate from any other attached standard labels. This first main embodiment is referred to as a standalone security label. This main embodiment is sewn on to the garment and soft goods and may include a cut line to provide the option of being removed conveniently.

The second main embodiment is providing a security label which combines a security device with an information label. The information label may contain care instructions (machine washable and/or drying process), the type of garment material, size, and/or brand name. This second embodiment is referred to as a combination security label. Like the first main embodiment, the second main embodiment is sewn on to the garment and soft goods and may include a cut line to provide the option of being removed. The information label remains on the garment and soft goods.

Accordingly, it is an object of this invention to provide a security label, as an anti-theft device, for attaching to all fabric garments and all fabric soft goods economically.

Another object of this invention is to provide a security label for sewing on to fabric garments and soft goods separate from the conventional label and providing an option for cutting the security label from the garment and soft goods without damaging the garment or soft goods, whether or not this removal option is indicated on the label or otherwise to the consumer.

A further object of this invention is to provide a security label for sewing on to fabric garments and soft goods which combines a security device with an information label and providing an option for cutting the security device from the security label while leaving the information label attached to the garment and soft goods without damaging the garment and soft goods, whether or not this removal option is indicated on the label or otherwise to the consumer.

Another object of this invention is to provide the first main embodiment security label and the second main embodiment security label by providing an option of leaving the security label permanently attached to the garment and soft goods without interrupting the magnetic, RF or acustomagnetic sensing field when use with security devices that can be deactivated at the point of sale.

Still a further object of this invention is to provide a security label for sewing on to fabric garments and soft goods to permit the use of the same or similar sewing machines and handling devices already being used by the garment and soft goods manufacturers to sew in the conventional information labels.

Still a further object of this invention is to provide a security label that provides protection for the security device from the effects of the garment manufacturers' processes and from the subsequent effects of home washings by providing a water tight enclosure.

DETAILED DESCRIPTION OF THE PREFERRED EMBODIMENTS

Figure 3:
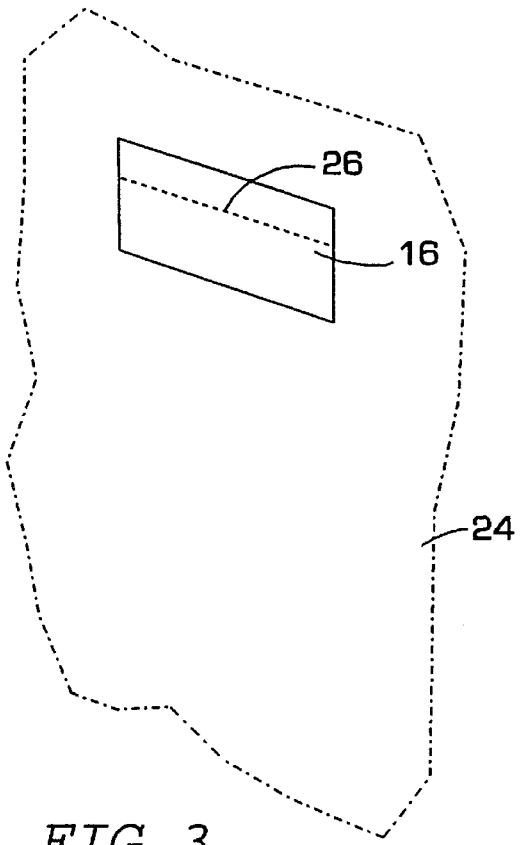
FIG. 3 is a perspective view of embodiment one showing the security device removed from the single tab.
Figure 2:
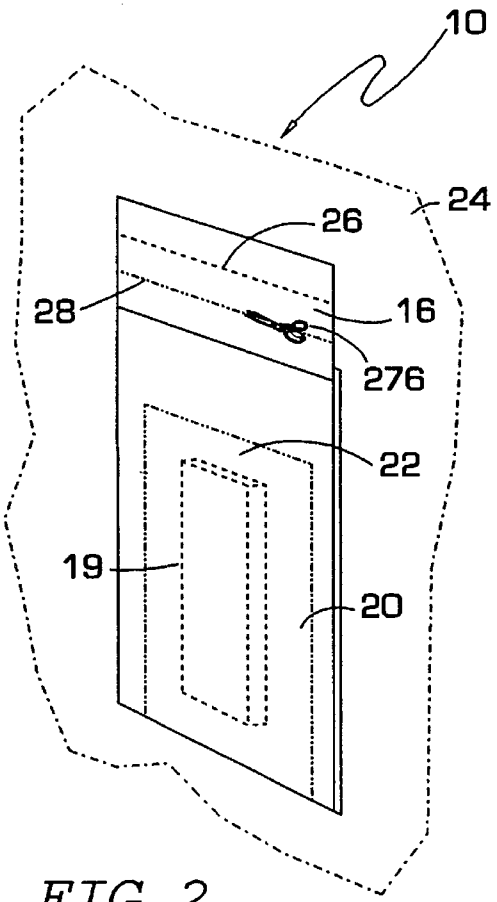
FIG. 2 is a perspective view of embodiment one showing the security device enclosed.
Figure 1:
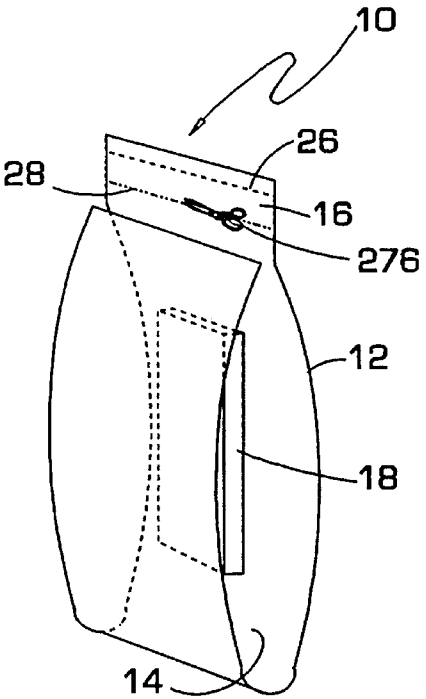
FIG. 1 is a perspective view of embodiment one of a standalone security label having a single tab.

In the illustrated embodiment of FIGS. 1–3, a security label 10, standalone embodiment one, for the garment and soft goods industry includes a loop 12 of fabric material forming a pocket 14. The loop 12 also provides a single tab 16 of one thickness of fabric material integrally extending therefrom. A security device 18, such as a flat metallic strip, is seated inside the pocket 14. Referring to FIG. 2, the security label 10 is then heat-sealed on sides 19, 20, and 22 for completely enclosing the security device 18 by using a conventional heat seal process or by using an ultrasonic sealing process.

Figure 39:
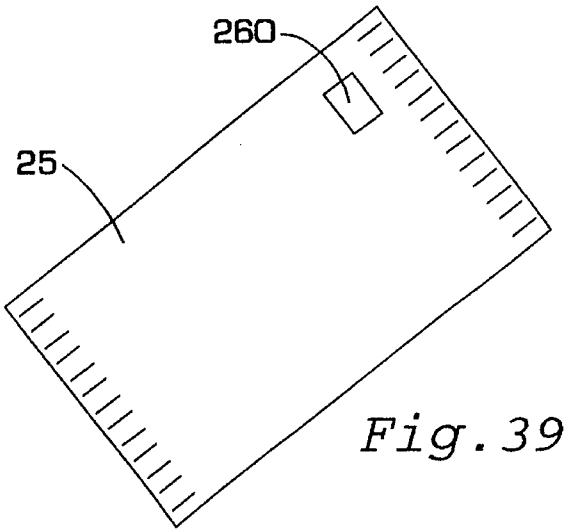
FIG. 39 is a plan view of a towel representing soft goods, as an example, showing a standalone security label.
Figure 38:
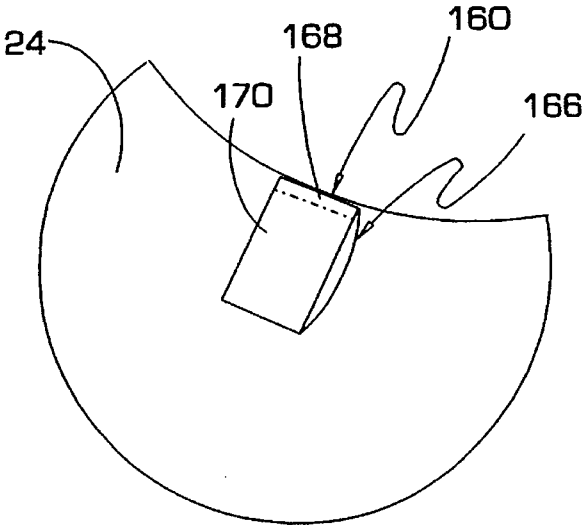
FIG. 38 is a plan view of a neck portion of a garment of fabric material, as an example, showing a combination security label.
Figure 37:
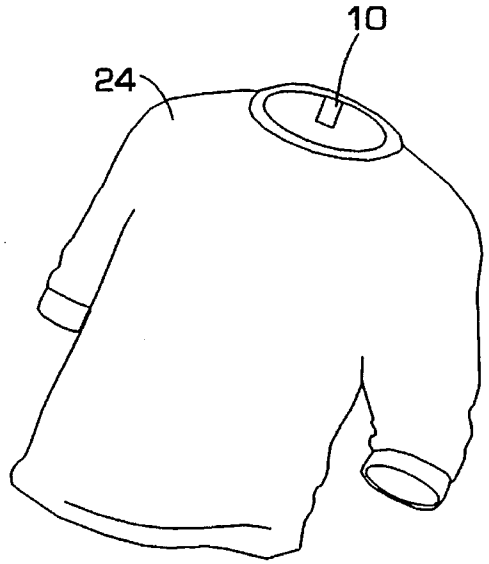
FIG. 37 is a plan view of a garment of fabric material, as an example, showing a standalone security label.

The sealed security label 10 may be made of such material, or coated with such material to provide a water tight pocket 14 to protect the security device 18 from damage or rust and to protect a garment 24 and soft goods 25 (FIG. 39) from rust or stain from the security device 18. Also, the sealed security label 10 will prevent the user from coming in direct contact with the security device 18 to prevent physical irritation such as scratching or cutting. The security device 18 may be made of such material or coated with such material to protect the security device from home laundering, steam pressing, ironing, and dry cleaning.

The sealed security label 10 is then sewn on to the garment 24 or soft goods 25 along a seam in line 26 on the single tab 16. One option is to leave the security label 10 permanently attached to the garment 24. Another option is to remove the security label 10 from the garment 24 by cutting along a cut line 28 after the sales transaction such as at the retail store or after leaving the retail store. If the security label 10 is removed from the garment 24, the single tab 16 remains sewn on the garment 24 (FIG. 3).

The fabric material used to make the security label can be acetate, cotton, nylon, polyester and combinations there of, in woven and non-woven form, and can be coated and non coated materials.

Embodiment one is considered a standalone security label since the security label 10 only serves one purpose. The one purpose is to attach the security device 18 to the garment 24. Other embodiments to be described later, which serve two or more purposes, will be considered combination security labels. A first purpose is to attach the security device 18 to the garment 24 and a second purpose is to apply garment information, such as, care instructions,(machine washable), identify garment material, size, and/or brand naming or combinations there of.

Figure 6:
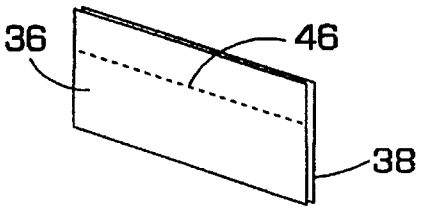
FIG. 6 is a perspective view of embodiment two showing the security device removed from the double tab.
Figure 5:
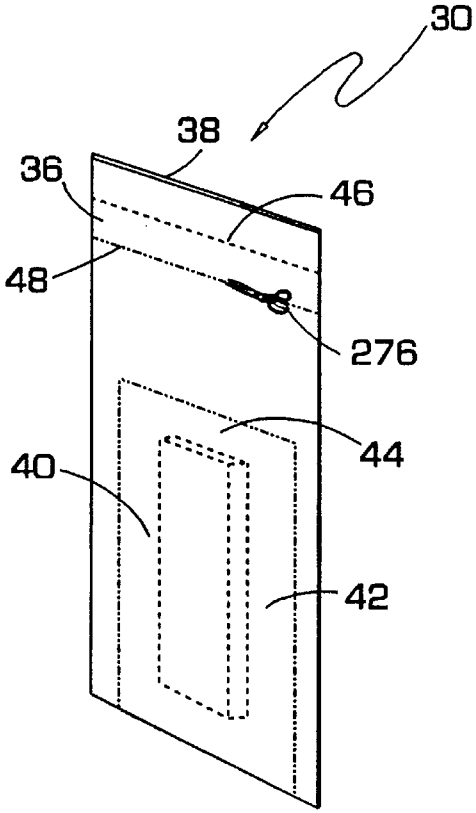
FIG. 5 is a perspective view of embodiment two showing the security device enclosed.
Figure 4:
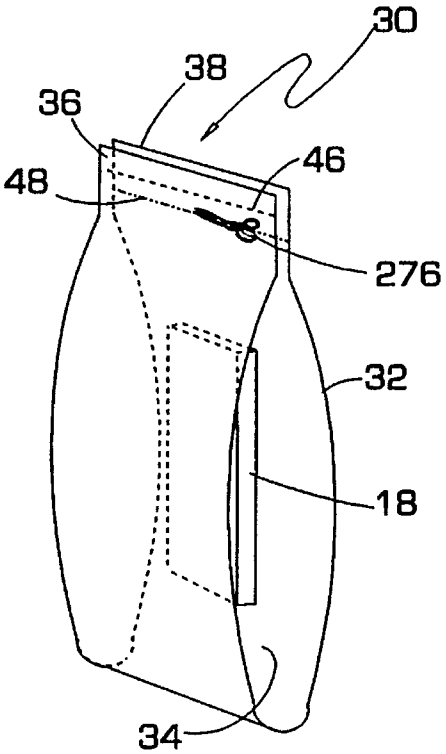
FIG. 4 is a perspective view of embodiment two of a standalone security label having a double tab.

Referring to FIGS. 4–6, a security label 30, standalone embodiment two, includes a loop 32 of fabric material forming a pocket 34 and providing double tab 36 and 38 of two thicknesses of fabric material integrally extending from the loop 32. The security device 18 is seated inside the pocket 34. Referring to FIG. 5, the security label 30 is then heat sealed on sides 40, 42, and 44 for completely enclosing the security device 18 by a method similar to embodiment one.

The sealed security label 30 will provide a water tight pocket 34, will prevent the user from coming in direct contact with the security device 18, and will be protected from most manufacturing processes and user processes such as laundering and pressing similar to embodiment one.

The sealed security label 30 is then sewn on to the garment 24 or soft goods 25 along a sew line 46 on the double tab 36 and 38. As in embodiment one, one option is to leave the security label 30 permanently attached to the garment 24. Another option is to remove the security label 30 from the garment 24 but cutting along a cut line 48 after the sales transaction. If the security label 30 is removed from the garment 24, the double tab 36 and 38 remain sewn on the garment 24 (FIG. 6).

Figure 9:
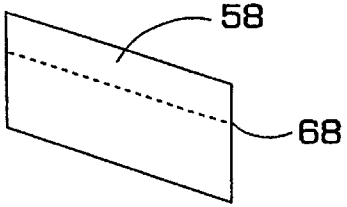
FIG. 9 is a perspective view of embodiment three showing the security device removed from the single tab.
Figure 8:
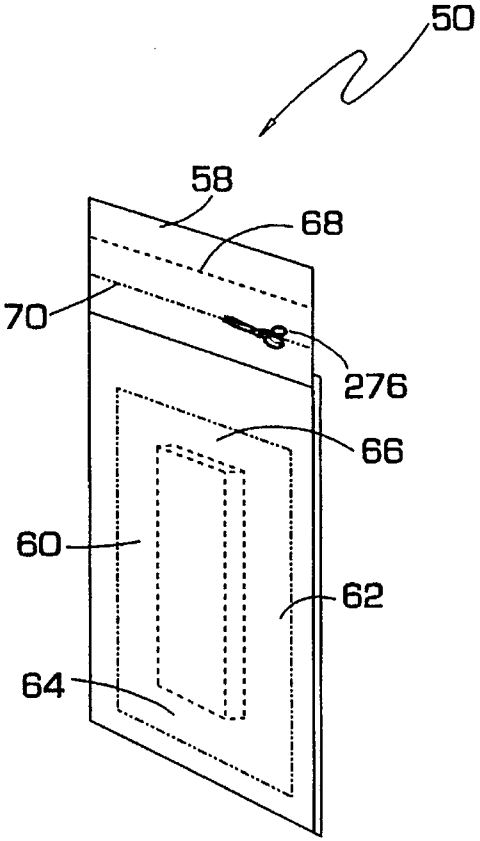
FIG. 8 is a perspective view of embodiment three showing the security device enclosed.
Figure 7:
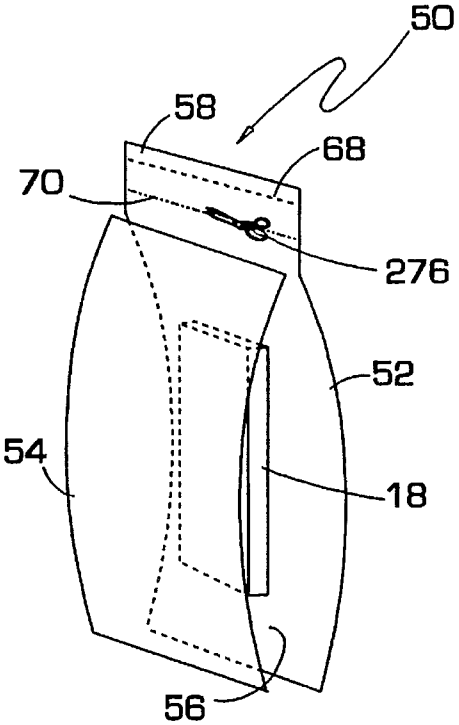
FIG. 7 is a perspective view of embodiment three of a standalone security label having two separate fabric halves with one half including a single tab.

Referring to FIGS. 7–9, a security label 50, standalone embodiment three, includes a first section 52 and a second separate section 54 forming a pocket 56 for the security device 18. A single tab 58 integrally extends from the first section 54. With this embodiment, the fabric material selected for the first section 52 would be desirable for sewing the security label 50 to the garment 24. The material selected for the second section 54 could be different from the first section 52 to be more suitable for a heat sealing process, aesthetics or other purposes. The security device 18 is seated inside the pocket 56. Referring to FIG. 8, security label 50 is then heat sealed on sides 60, 62, 64 and 66 for completely enclosing the security device 18 by a method similar to embodiment one.

The sealed security label 50 will provide a water tight pocket 56, will prevent the user from coming in direct contact with the security device 18, and will be protected from most manufacturers' processes and user processes such as laundering and pressing similar to embodiment one.

The sealed security label 50 is then sewn on to the garment 24 or soft goods 25 along a sew line 68 on the single tab 58. As in embodiment one, one option is to leave the security label 50 permanently attached to the garment 24. Another option is to remove the security label 50 from the garment 24 by cutting along a cut line 70 after the sales transaction. If the security label 50 is removed from the garment, the single tab 58 remains sewn on the garment 24 (FIG. 9).

Figure 12:
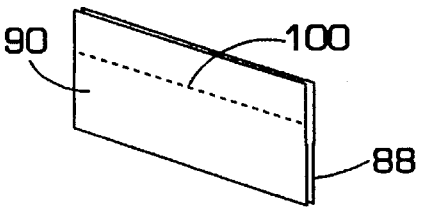
FIG. 12 is a perspective view of embodiment four showing the security device removed from the double tab.
Figure 11:
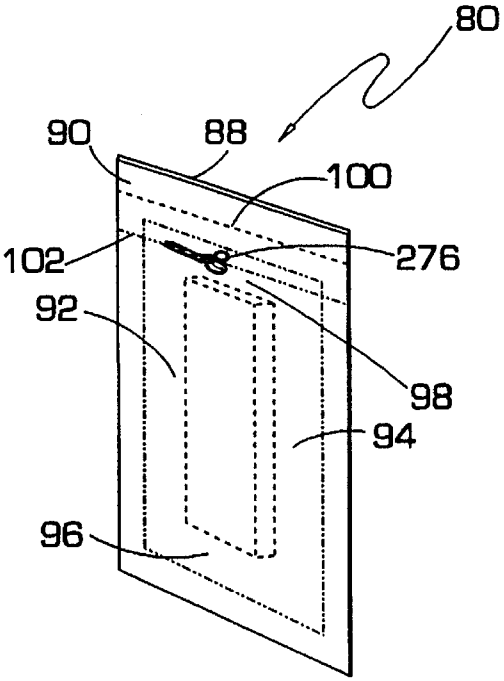
FIG. 11 is a perspective view of embodiment four showing the security device enclosed.
Figure 10:
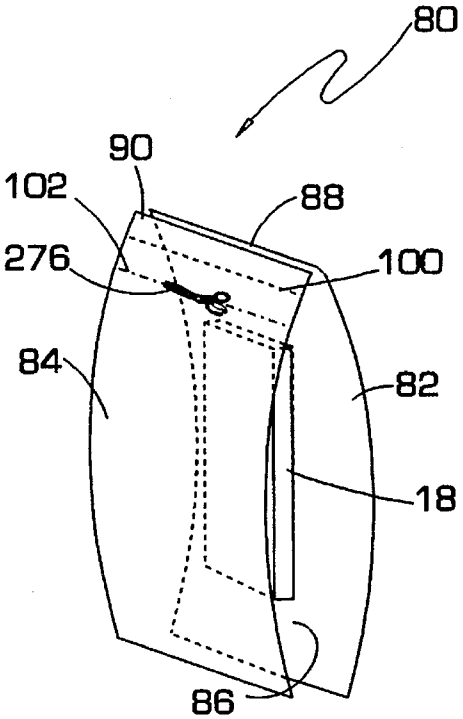
FIG. 10 is a perspective view of embodiment four of a standalone security label having two separate fabric halves with both halves forming a double tab.

Referring to FIGS. 10–12, a security label 80, standalone embodiment four, includes a first section 82 and a second section 84 forming a pocket 86 for the security device 18. A first tab 88 integrally extends from the first section 82. A second tab 90 integrally extends from the second section 84. With this embodiment, the fabric material selected for the first section 82 would be desirable for sewing the security label 80 to the garment 24. The material selected for the second section 84 could be different from the first section 82 to be more suitable for a combination of heat sealing process and for sewing the security label 80 to the garment 24 or for aesthetic or other reasons. By sewing the first tab 88 and the second tab 90 to the garment 24, it would be more difficult to try removing the security label 80 from the garment 24 without damaging the garment 24 than having only the first tab 88 sewn to the garment 24. The security device 18 is seated inside the pocket 86. Referring to FIG. 11, the security label 80 is then heat sealed on sides 92, 94, 96, and 98 for completely enclosing the security device 18 by a method similar to embodiment one.

The sealed security label 80 will provide a water tight pocket 86, will prevent the user from coming in direct contact with the security device 18, and will be protected from most manufacturers' processes as well as user processes such as laundering and pressing similar to embodiment one.

The sealed security label 80 is then sewn on to the garment 24 or soft goods 25 along a sew line 100 through the first tab 88 and the second tab 90. As in embodiment one, one options is to leave the security label 80 permanently attached to the garment 24. Another options is to remove the security label 80 from the garment 24 by cutting along a cut line 102 after the sales transaction. If the security label 80 is removed from the garment 24, the first tab 88 and the second tab 90 remain sewn to the garment 24 (FIG. 12).

Figure 15:
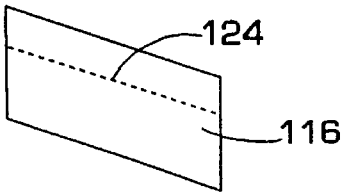
FIG. 15 is a perspective view of embodiment five showing the security device removed from the single tab.
Figure 14:
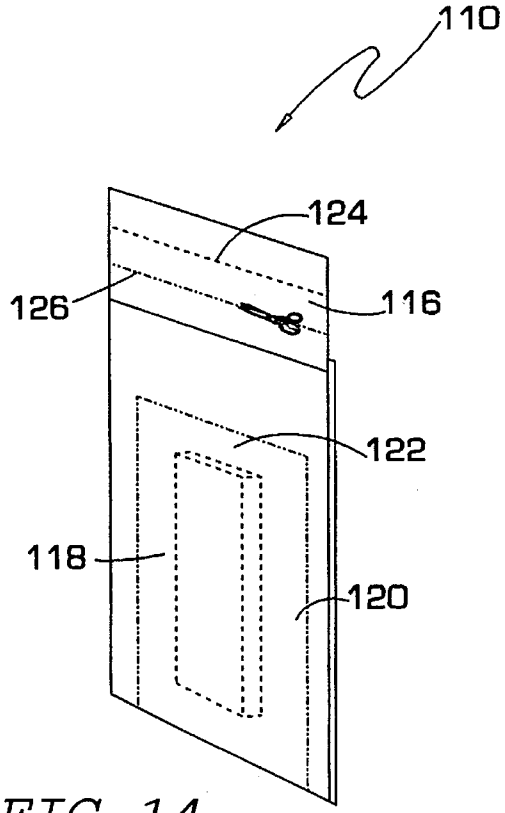
FIG. 14 is a perspective view of embodiment five showing the security device enclosed.
Figure 13:
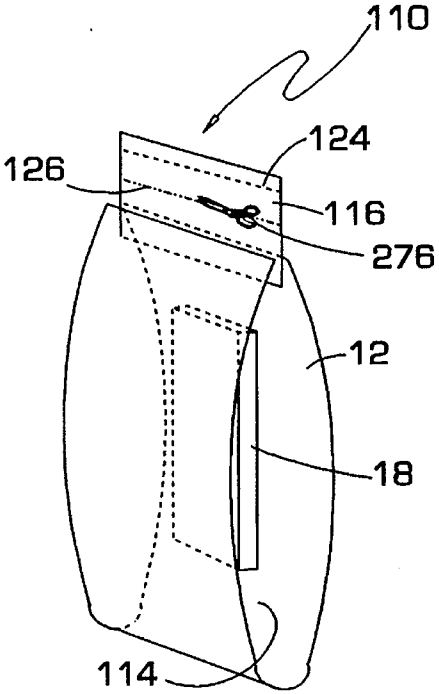
FIG. 13 is a perspective view of embodiment five of a standalone security label having a loop formed from a fabric material and having a single tab formed from a different material.

Referring to FIGS. 13–15, a security label 110, standalone embodiment five, includes a loop 112 of fabric material forming a pocket 114 for the security device 18. A single tab 116 is formed from a material different from the fabric material selected for the loop 12. The material selected for the single tab 116 would be suitable for attaching the security label 110 to the garment 24 by different methods such as heat sealing, traditional sewing or ultrasonically sewing. The material selected for the single tab 116 can also be water soluble so that the tab 116 will dissolve and fall off from normal home laundering. A soft material can be selected for the tab 116 such that only the soft tab 116 remains on the garment 24 when the security label 110 has been removed. The soft tab 116 would not be noticed by the user and could be particularly useful for garments worn next to the skin.

The security device 18 is seated inside the pocket 114. Referring to FIG. 14, the security label 110 is then heat sealed on sides 118, 120, and 122 for completely enclosing the security device 18 by a method similar to embodiment one.

The sealed security label 110 will provide a water tight pocket 114, will prevent the user from coming in direct contact with the security device 18, and will be protected from most manufacturers' processes as well as user processes such as laundering and pressing similar to embodiment one.

The sealed security label 110 is then sewn on to the garment 24 or soft goods along a sew line 124 through the single tab 116. As in embodiment one, one option is to leave the security label 110 permanently attached to the garment 24. Another option is to remove the security label 110 from the garment 24 by cutting along a cut line 126 after the sale transaction. If the security label 110 is removed from the garment 24, the single tab 116 remains sewn on the garment 24 (FIG. 15).

Figure 18:
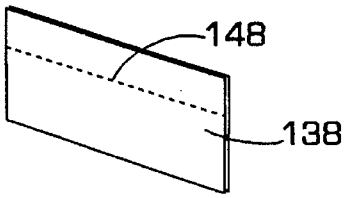
FIG. 18 is a perspective view of embodiment six showing the security device removed from the single tab.
Figure 17:
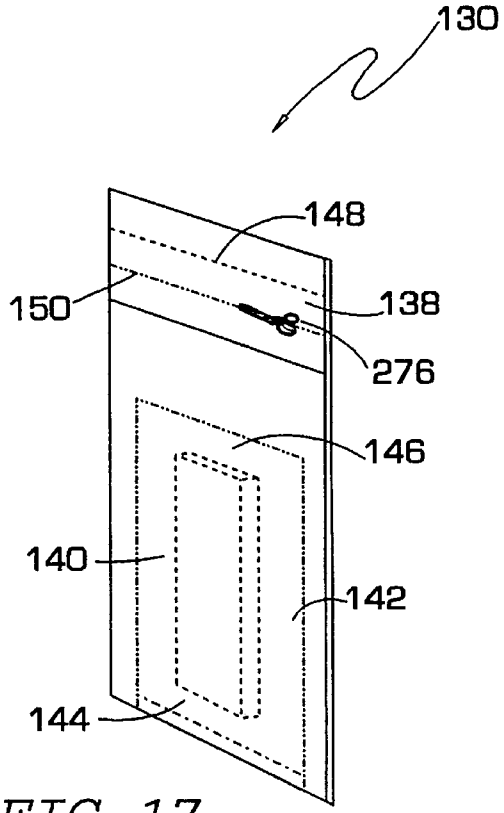
FIG. 17 is a perspective view of embodiment six showing the security device enclosed.
Figure 16:
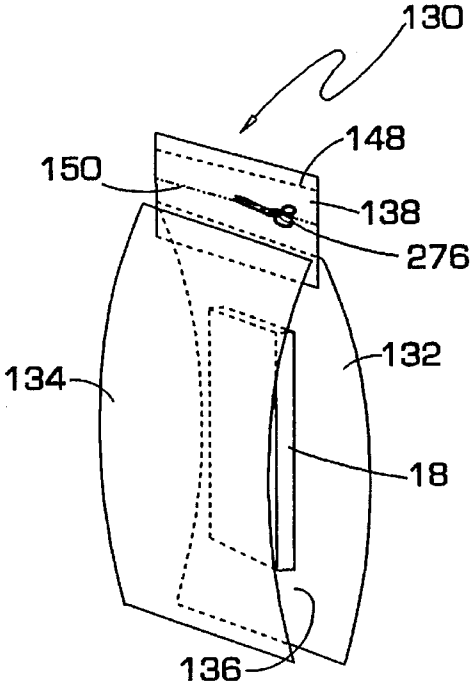
FIG. 16 is a perspective view of embodiment six of a standalone security label having two separate fabric halves and having a single tab formed from a different material.

Referring to FIGS. 16–18, a security label 130, standalone embodiment six, includes a first section 132 and a second section 134 forming a pocket 136 for the security device 18. A single tab 138 is formed from a material different from the fabric material selected for the first section 132 and the second section 134 and can be the same material selected for the single tab 116 of FIG. 13. With is embodiment, the fabric material selected for the first section 132 and the second section 134 would be desirable for a heat sealing process to enclose the security device 18 in the pocket 138. Referring to FIG. 17, the security label 130 is then heat sealed on sides 140, 142, 144, and 146 for completely enclosing the security device 18 by a method similar to embodiment one.

The sealed security label 130 will provide a water tight pocket 136, will prevent the user from coming in direct contact with the security device 18, and will be protected from most manufacturers' processes as well as user processes such as laundering and pressing similar to embodiment one.

The sealed security label 130 is then sewn on to the garment 24 or soft goods 25 along a sew line 148 through the single tab 138. As in embodiment one, one option is to leave the security label 130 permanently attached to the garment 24. Another option is to remove the security label 130 from the garment 24 by cutting along a cut line 150 after the sales transaction. If the security label 130 is removed from the garment 24, the single tab 138 remains sewn on the garment 24 (FIG. 18) and could be particularly useful for garments worn next to the skin.

Figure 21:
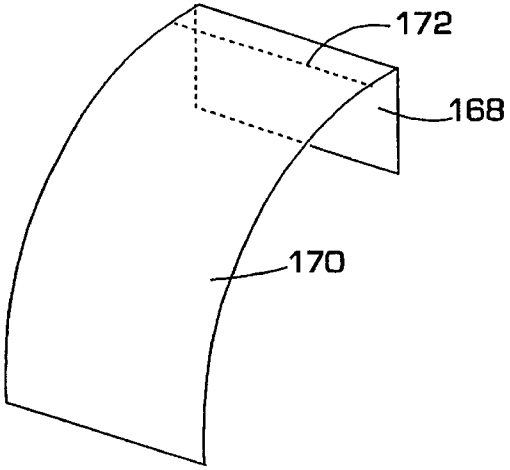
FIG. 21 is a perspective view of the combination embodiment one showing the security device removed from the security label.
Figure 20:
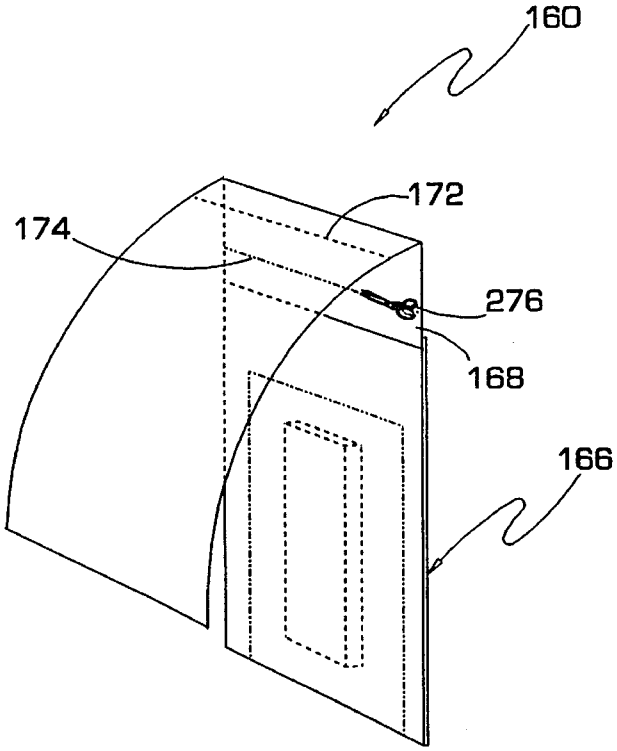
FIG. 20 is a perspective view of the combination embodiment one showing the security device enclosed.
Figure 19:
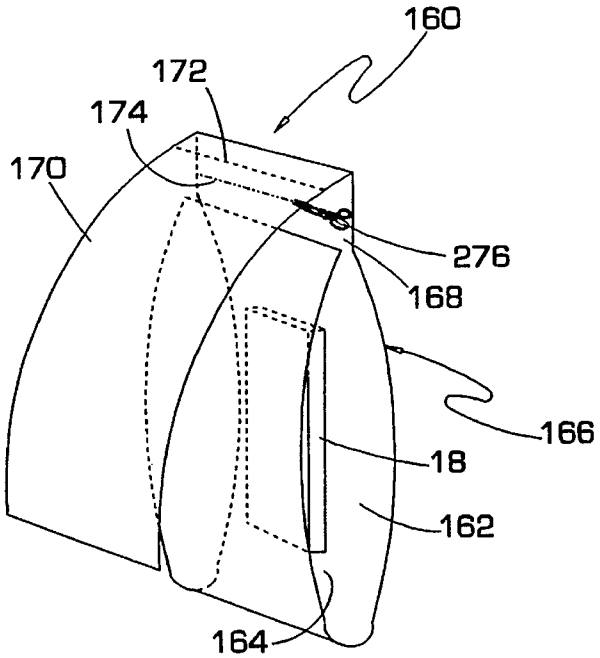
FIG. 19 is a perspective view of a combination embodiment one of a security label having a security device combined with garment information and having two folds formed in the fabric material.

Referring to FIGS. 19–21, a security label 160, combination embodiment one, includes a loop 162 of fabric material forming a pocket 164 for the security device to provide a security device portion 166. The loop 162 also provides an integrally formed tab 168 and an additional integrally formed section 170. The purpose of the section 170 is to provide information about the garment 24 such as brand name, care instructions, size, and the kind of fabric material. Section 170 also covers the cut off portion 168 of the label covering any rough edge so as not to irritate the wearer.

Figure 24:
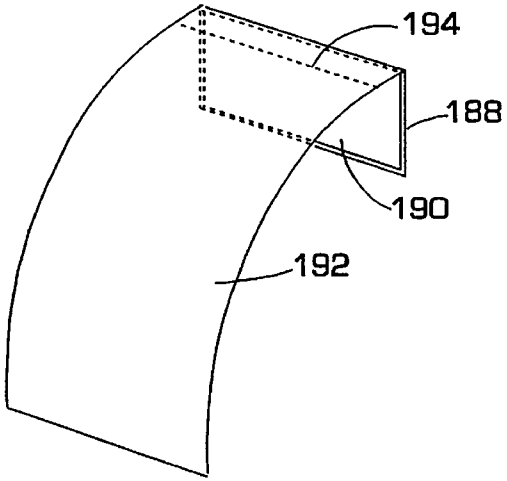
FIG. 24 is a perspective view of combination embodiment two showing the security device removed from the security label.
Figure 23:
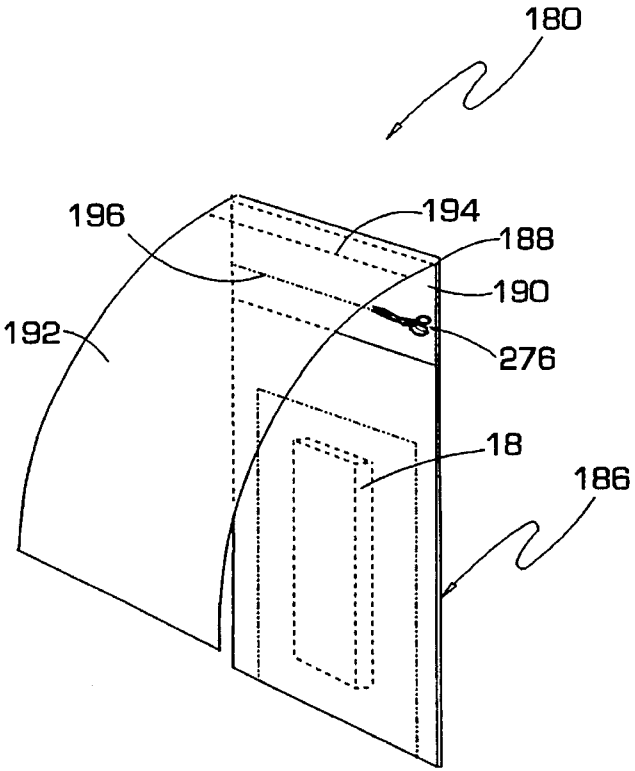
FIG. 23 is a perspective view of the combination embodiment two showing the security device enclosed.
Figure 22:
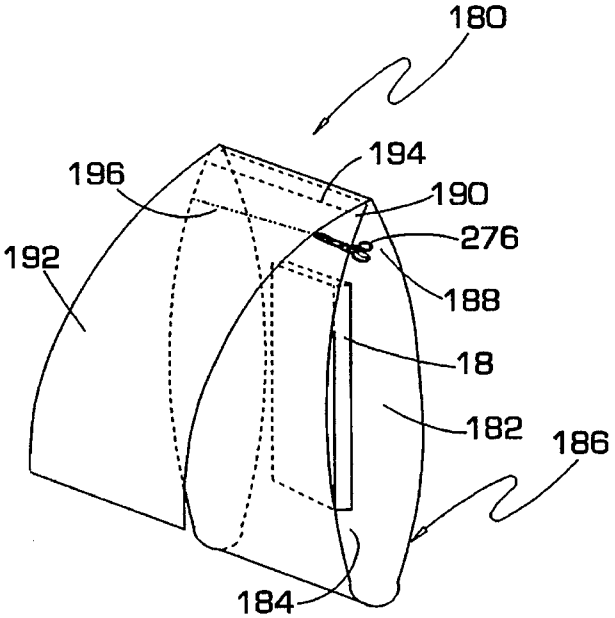
FIG. 22 is a perspective view of a combination embodiment two of a security label having a security device combined with garment information and having a sew line located to sew through three layers of fabric material.

The security device portion 166 of the security label 160 is best sealed for completely enclosing the security device 18 similar to FIGS. 2 and 5 (FIG. 20). The security label 160 is then sewn on to the garment 24 along a sew line 172 through the section 170 and the tab 168. One option is to leave the security device portion 166 permanently attached to the garment 24. Another option is to remove the security device portion 166 from the garment 24 by cutting along a cut line 174 after the sales transaction. If the security device portion 166 is removed from the garment 24, the tab 168 and the section 170 remain sewn on the garment 24 (FIG. 21). Referring to FIGS. 22–24, a security label 180, combination embodiment two, includes a loop 182 of fabric material forming a pocket 184 for the security device 18 to provide a security device portion 186. The loop 182 also provides a first integrally formed tab 188, a second integrally formed tab 190, and an additional integrally formed section 192. The purpose for the section 192 is the same as the purpose for the section 170 of FIGS. 19–21.

The security device portion 186 is heat sealed similar to FIGS. 2, 5, and 20 as shown in FIG. 3. The security label 180 is then sewn on to the garment 24 along a sew line 194 through the section 192, the first tab 188, and the second tab 190. By sewing the section 192, the first tab 188, and the second tab 190, it would be more difficult to try to remove the security device portion 186 from the garment without damaging the garment than having only the first tab 188 and the section 192 sewn to the garment 24.

One option is to leave the security device portion 186 permanently attached to the garment 24. Another option is to remove the security device portion 186 from the garment 24 by cutting along a cut line 196 after the sales transaction. If the security device portion 186 is removed from the garment 24, the first tab 188, the second tab 190, and the section 192 remain sewn on the garment 24 (FIG. 24). Section 192 also covers the cut off portion 190 of the label covering any rough edge so as not to irritate the wearer.

Figure 26:
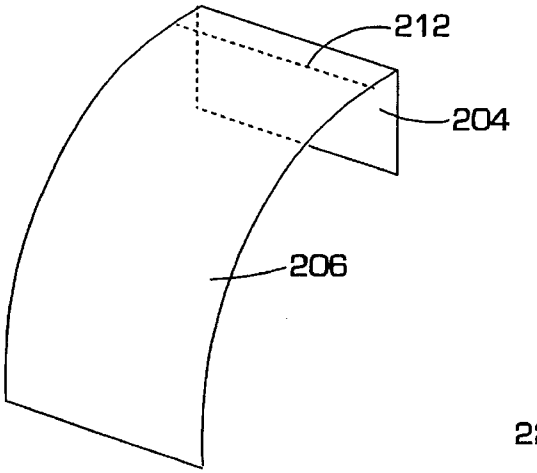
FIG. 26 is a perspective view of the combination embodiment three showing the security device removed from the security label.
Figure 25:
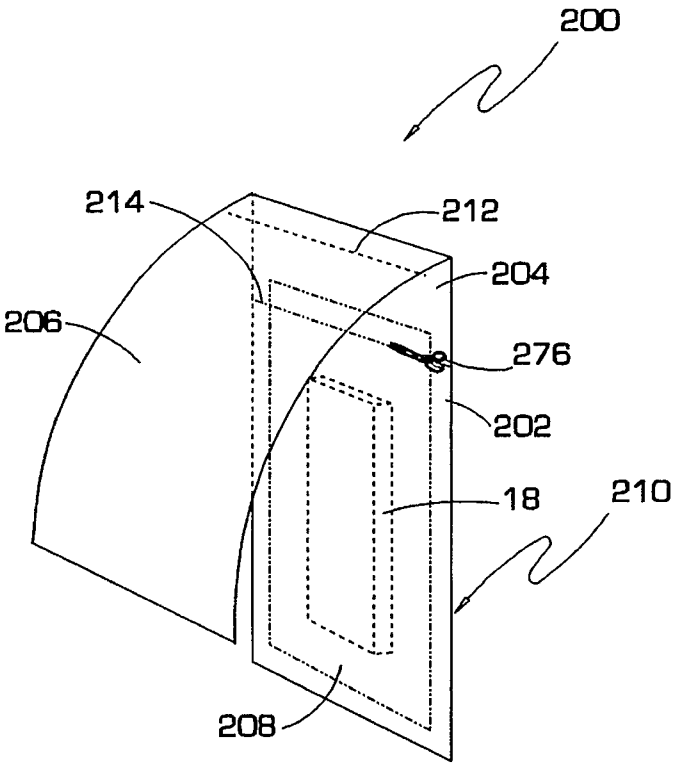
FIG. 25 is a perspective view of a combination embodiment three of a security label having a security device combined with garment information and having the information a separate part from the security device support.

Referring to FIGS. 25 and 26, a security label 200, combination embodiment three, includes a first section 202, an integrally formed tab 204, and an additional integrally formed section 206. The purpose for the section 206 is to provide information about the garment 24 similar to the section 170 of FIGS. 19–21. A third separate section 208 is formed from a heat seal material for attaching the security device 18 to the first section 202 to provide a security device portion 210.

The security device portion 210 is heat sealed similar to FIGS. 20 and 23. The security label 200 is then sewn on to the garment 24 along a sew line 212 through the section 206 and the tab 204.

One option is to leave the security device portion 210 permanently attached to the garment 24. Another option is to remove the security device portion 210 from the garment 24 by cutting along a cut line 214 after the sales transaction. If the security device portion 210 is removed from the garment 24, the tab 204 and the section 206 remain sewn on the garment 24 (FIG. 26). Section 206 also covers the cut off portion 204 of the label covering any rough edge so as not to irritate the wearer.

Figure 27:
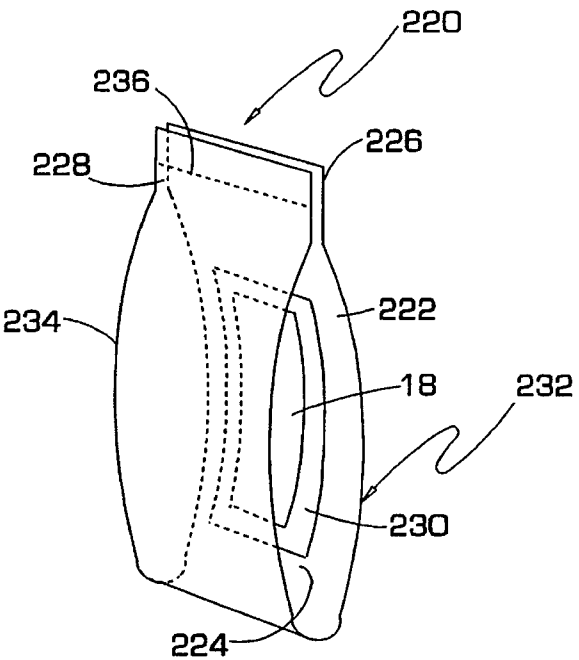
FIG. 27 is a perspective view of a combination embodiment four of a security label having a security device combined with garment information and having the information and the security device support formed from the same fabric material.

Referring to FIG. 27, a security label 220, combination embodiment four, includes a loop 222 of fabric material forming a pocket 224 for the security device 18. The loop 222 also provides a first integrally formed tab 226 and a second integrally formed tab 228. A separate section 230 is formed from a heat seal material for attaching the security device 18 to a first portion 232 of the loop 222. A second portion 234 of the loop provides information about the garment 24 similar to the section 170 of FIGS. 19–21.

The security label 220 is then sewn on to the garment 24 along a sew line 236 through the first tab 226 and the second tab 228. This combination embodiment could remain permanently attached to the garment or would be removed like the previous embodiments. The advantage is that it is more difficult for a thief to remove due to the double thickness from the two tabs, 228 and 226.

Figure 30:
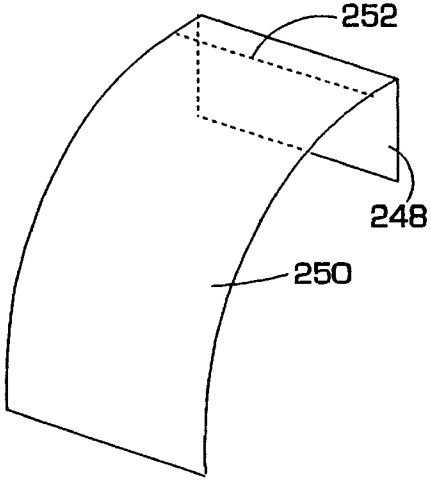
FIG. 30 is a perspective view of the combination embodiment five showing the security device removed from the security label.
Figure 29:
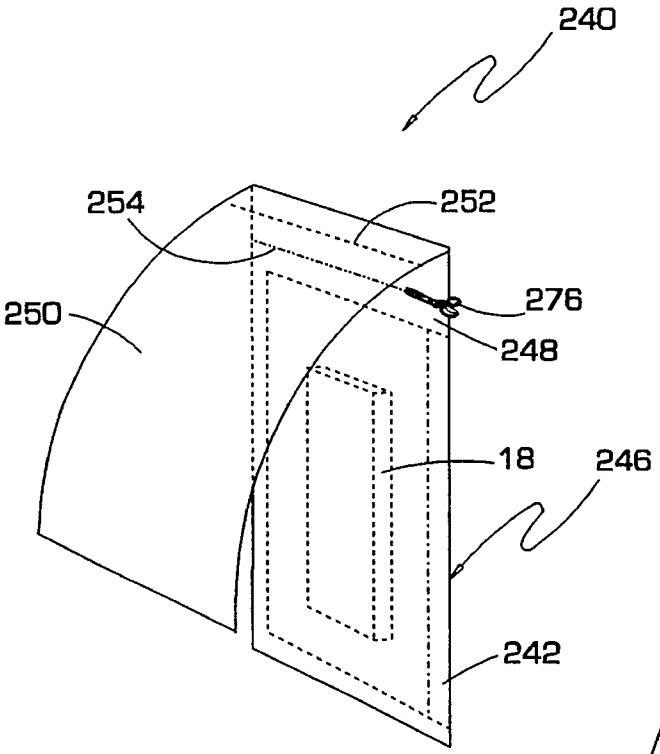
FIG. 29 is a perspective view of the combination embodiment five showing the security device enclosed.
Figure 28:
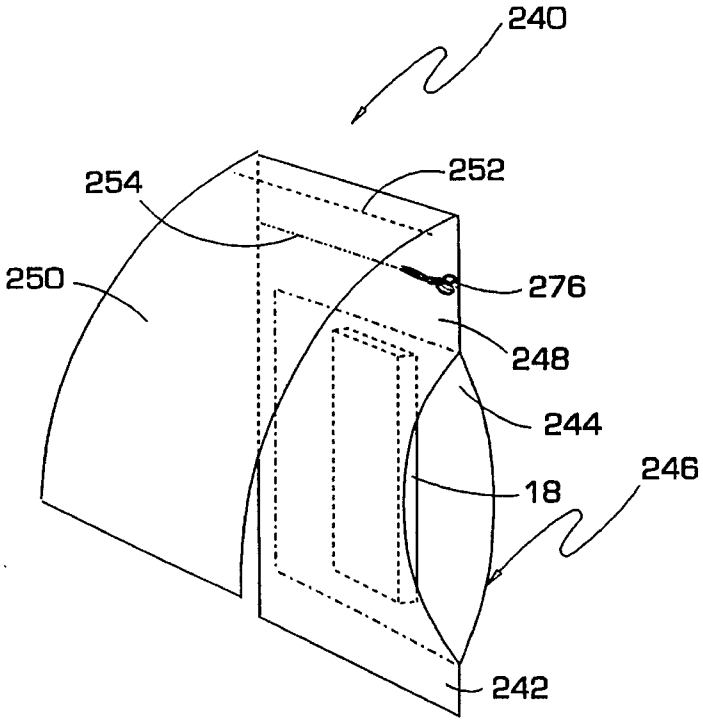
FIG. 28 is a perspective view of a combination embodiment five of a security label having a security device combined with garment information and having a pocket formed for receiving the security device.

Referring to FIGS. 28–30, a security label 240, combination embodiment five, includes a first single woven section 242 having a woven pocket 244 for the security device 18 to provide a security device portion 246. A tab 248 is integrally woven from the first section 242. A second single woven section 250 is integrally woven from the first section 242. The purpose of the second section 250 is to provide information about the garment 24 similar to the section 170 of FIGS. 19–21.

The security device 18 is seated in the pocket 244. The security device portion 246 is sealed by heat sealing or ultrasonic sealing techniques (FIG. 29). The security label 240 is then sewn on to the garment 24 along a sew line 252 through the section 250 and the tab 248.

One option is to leave the security device portion 246 permanently attached to the garment 24. Another option is to remove the security device portion 246 from the garment 24 by cutting along a cut line 254 after the sales transaction. If the security device portion 246 is removed from the garment 24, the tab 248 and the second section 250 remain sewn on the garment 24 (FIG. 30).

Figure 32:
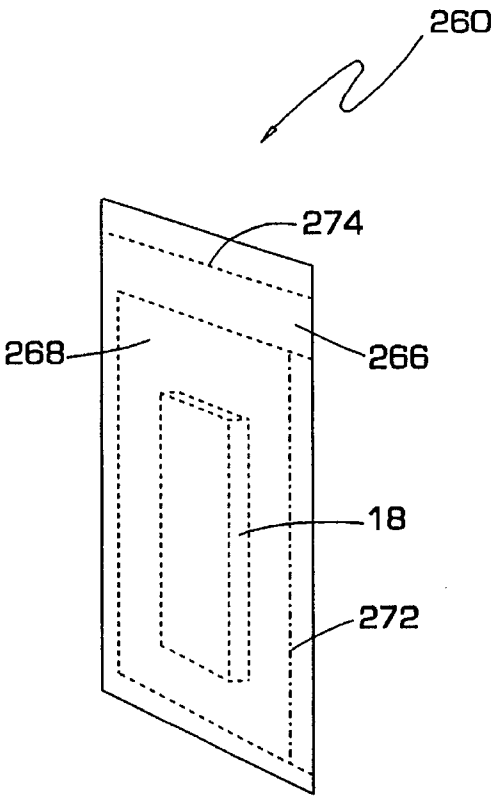
FIG. 32 is a perspective view of the combination embodiment six showing the security device enclosed.
Figure 31:
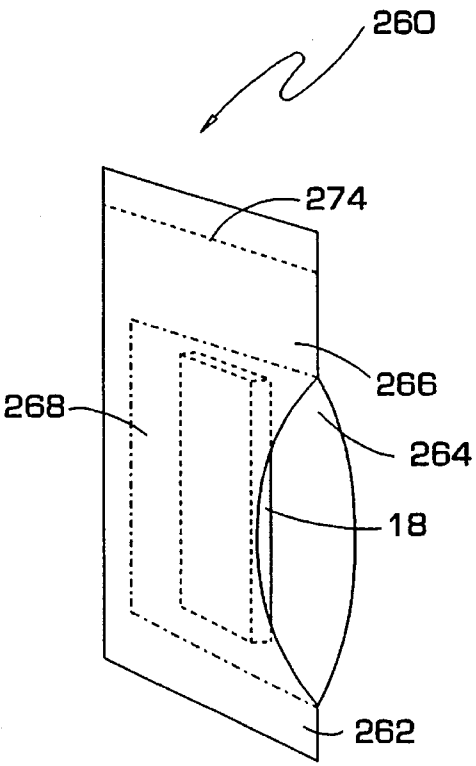
FIG. 31 is a perspective view of a combination embodiment six of a security label formed by a single weave and includes a woven pocket for receiving the security device and includes garment information.

Referring to FIGS. 31 and 32, a security label 260, combination embodiment six, includes a single woven section 262 having a woven pocket 264 for the security device 18 and having an integrally woven tab 266. Information about the garment 24 similar to the section 170 of FIGS. 19–21 is added to one side 268 of the pocket 264 by weaving or by a printing process.

The pocket 264 is sealed along one side 272 for completely enclosing the security device 18. The security label 260 is then sewn on to the garment 24 along a sew line 274. The options of leaving the security label 260 permanently attached to the garment 24 or removing the security label 260 from the garment 24 are available for this embodiment.

Figure 33:
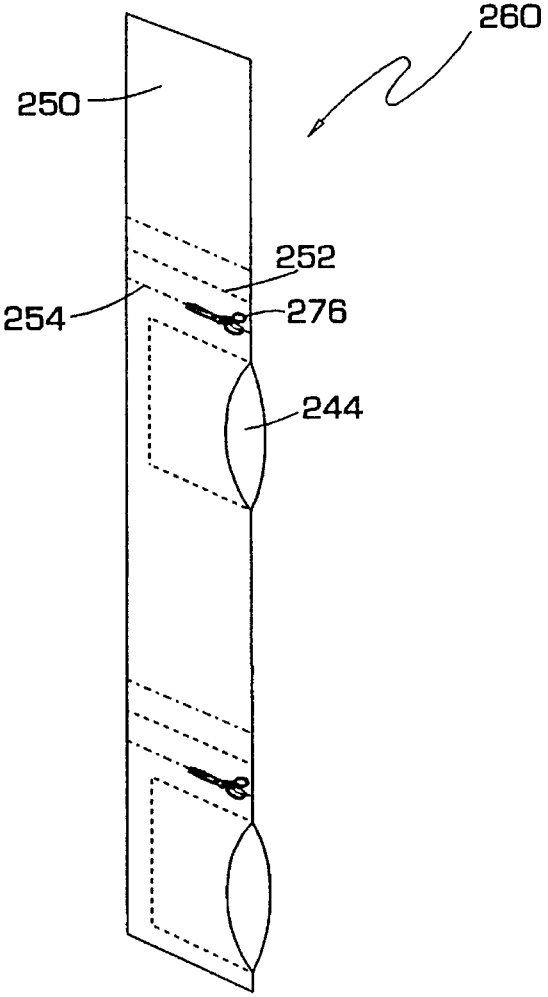
FIG. 33 is a perspective view of the combination embodiment five of a security label having a security device combined with garment information and having the security labels formed from one end to another by a single weave and by one label width.

Referring to FIG. 33, the security label 240 of FIG. 28 can be mass produced by a single weave process forming a single width label in an end to end formation. Scissors 276 or other cutting means, such as a hot knife or an ultrasonic slitter, usually employed in cutting woven fabrics may be used to provide individual security labels 240. Also where two security labels 240 meet 254, a special weave can be employed to prevent the unraveling of the woven fabric after cutting.

Figure 34:
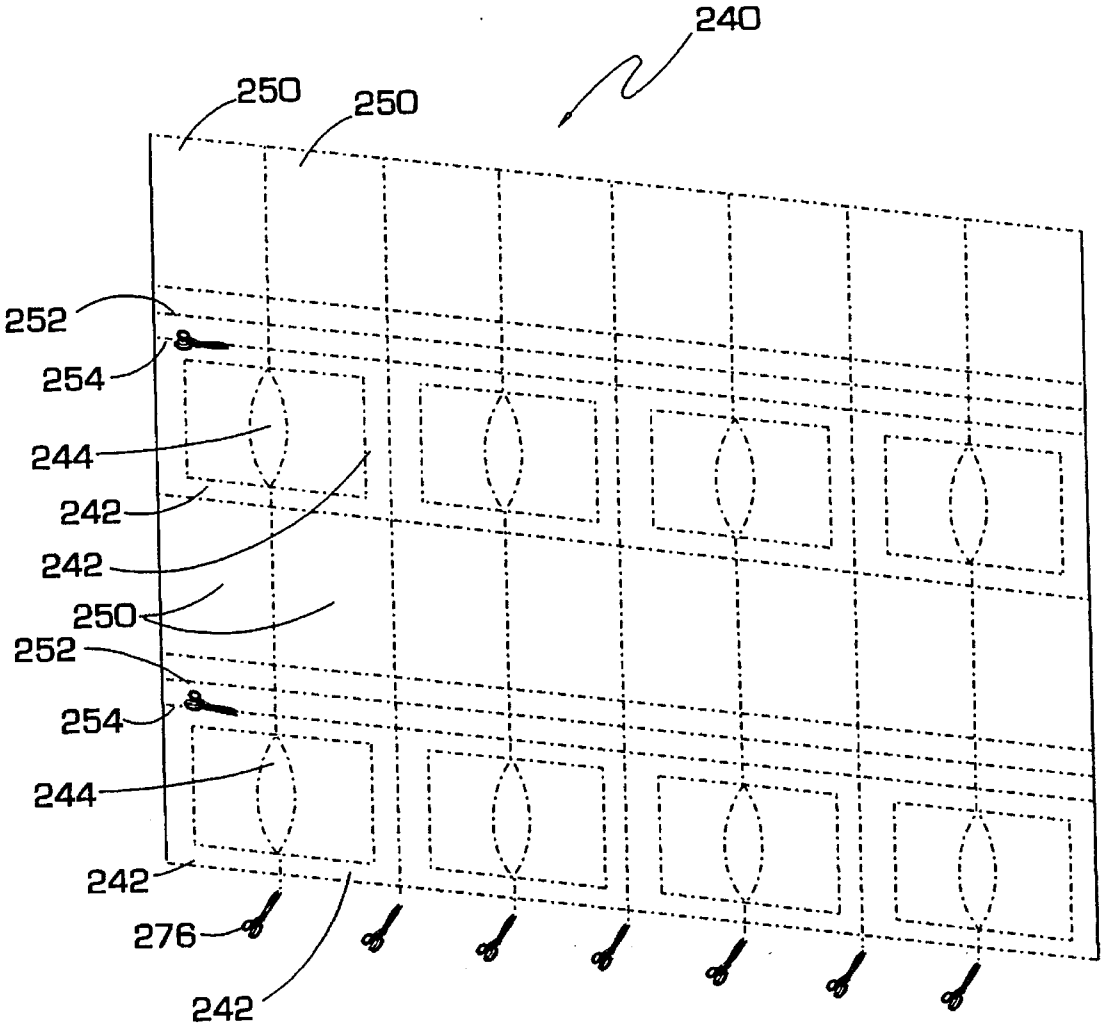
FIG. 34 is view similar to FIG. 33 except a multiple weave is used to form several label widths for later cutting into individual security labels.

Referring to FIG. 34, the security label 240 of FIG. 28 can be mass produced by a multiple weave process several labels side by side in an end to end formation. The open side 272 is located edge to edge for each pair of side by side labels. Scissors 276 or other cutting means usually employed in cutting woven fabrics may be used to provide individual security labels 240.

Figure 36:
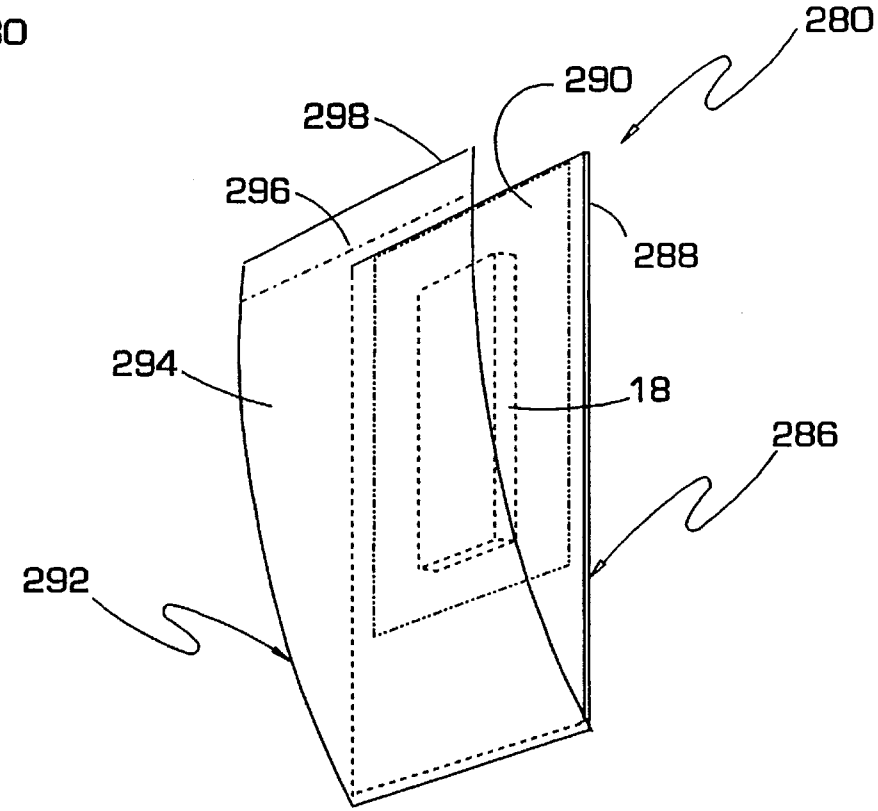
FIG. 36 is a perspective view of the combination embodiment seven showing the security device enclosed; See attached FIGS. 37, 38, 39 and 40.
Figure 35:
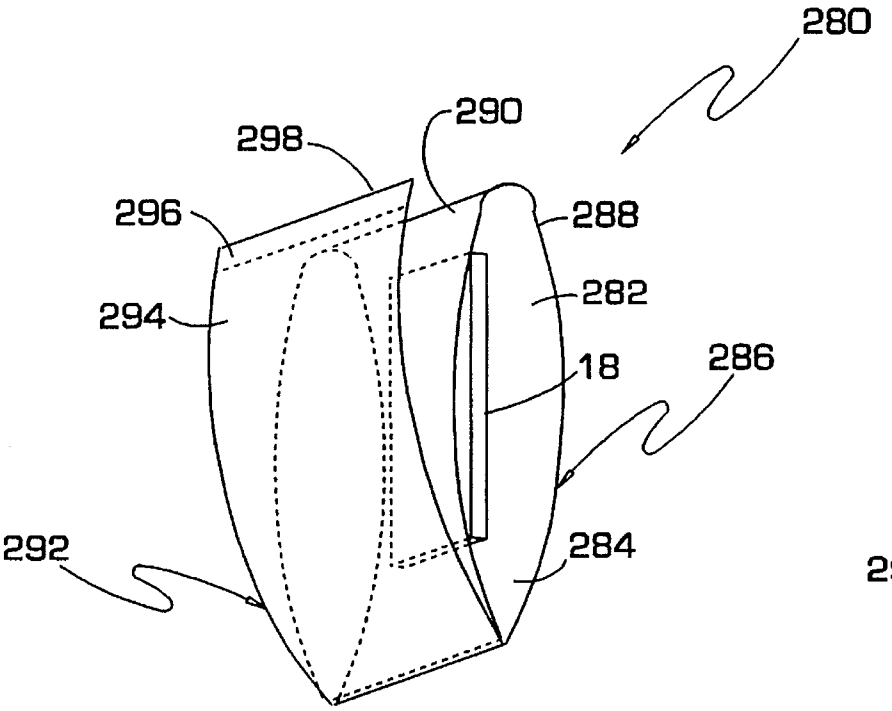
FIG. 35 is a perspective view of a combination embodiment seven of a security label having a security device combined with garment information and having a sew line located to sew through three layers of fabric material.

Referring to FIGS. 35 and 36, a security label 280, combination embodiment seven, includes a loop 282 of fabric material forming a pocket 284 for the security device 18 to provide a security device portion 286. The loop 282 has a first layer 288 and an adjacent second layer 290. A section 292 is integrally extending from the portion 286. A first purpose for the section 292 is the same as the purpose for the section 170 of FIGS. 19–21, which is to add garment information to the security label 280. A second purpose for the section 292 is to provide a third layer 294 of fabric material adjacent to the first layer 288 and to the second layer 290.

The security device portion 286 is heat sealed similar to FIG. 2 as shown in FIG. 36. The security label 280 is then sewn on to the garment 24 along a sew line 296 through the third layer 294 adjacent to the free end 298 of the section 292, the second layer 290, and the first layer 288. By sewing the security label 280 to the garment 24 through these three layers of fabric material, it would be very difficult to try to remove the security device portion 286 from the garment 24 without damaging the garment 24. Having the free end 298 sewn to the garment 24 further restricts access to the security device portion 286.

Figure 40:
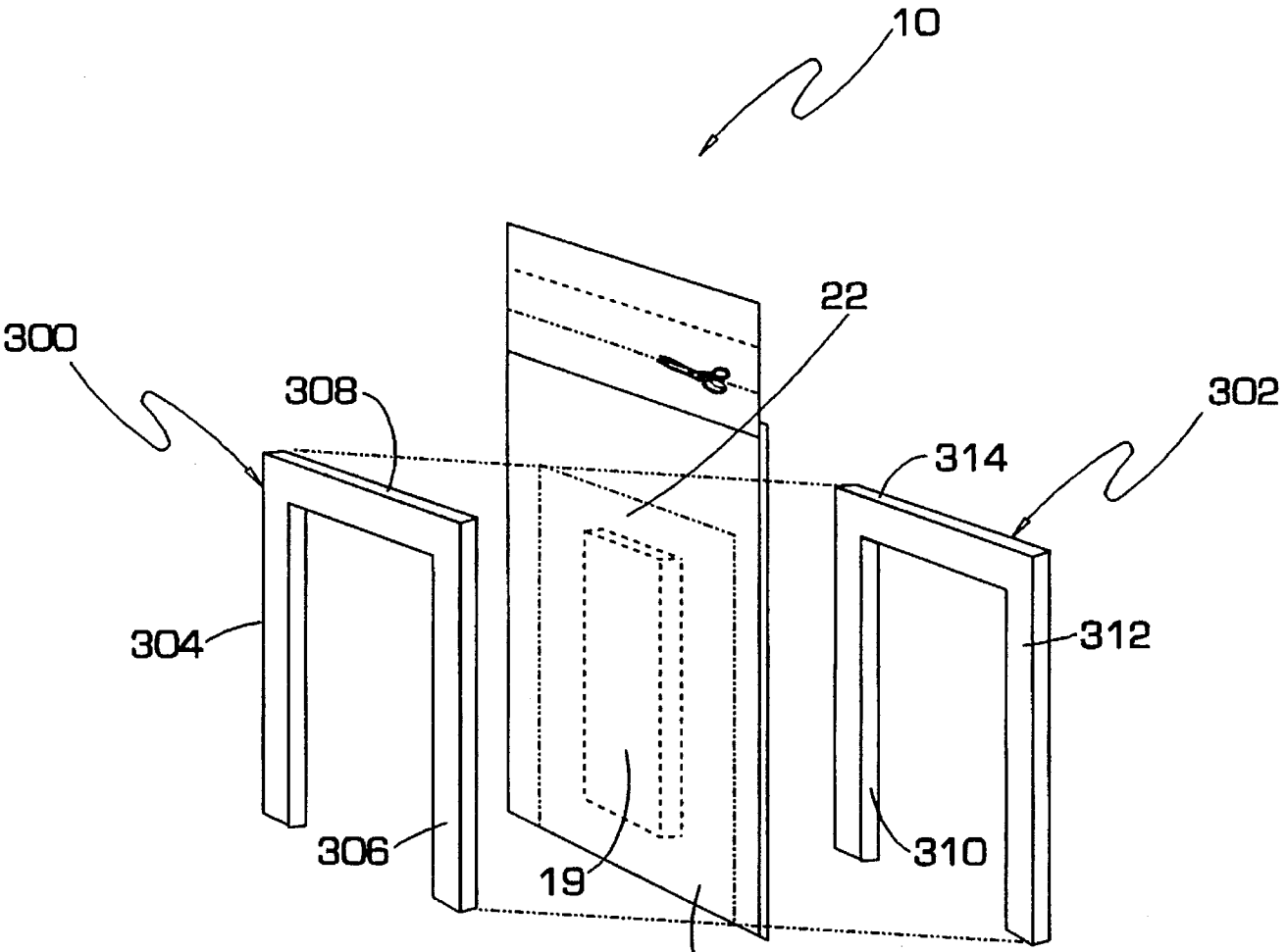
FIG. 40 is an exploded perspective view of heat seal elements of a heat sealing apparatus for heat sealing a security label of the present invention.

Referring to FIG. 40, the security label of FIG. 2 is shown heat sealed by a first heating element 300 located on one side of the security label 10 and by a second heating element 302 located on the opposite side of the security label 10. Bars 304, 306 and 308 of the first heating element 300 and bars 310, 312 and 314 on the second heating element 302 heat seal the sides 19, 20 and 22 respectively of the security label 10. A similar heat sealing apparatus can be used for heat sealing four sides of a security label as needed. Similarly the first heating element 300 and the second heating element 302 can seal the security label 10 using a ultrasonic sealing process.

The sealed security labels of FIGS. 20, 25, 27, 29, 32, and 36, as in the standalone embodiments, will provide water tight pockets, will prevent the user from coming in direct contact with the security device 18, and will be protected from laundering and pressing.

The fabric material used to make the previously described embodiments can be woven acetate, woven polyester, non-woven modified polyester, a woven polyester/cotton blend, woven nylon or cotton. Various finishes may be added to these fabric materials to meet particular needs such as for priming label information, being soft to the touch, different colors and others. These materials and finishes are shown and described in booklets titled "Fasco Tapes", "Product, Pricing, Information and Packaging" and "The Color Book" available at Paxar Systems Group, located in Sayre, Pa.

Obviously many modifications and variations of the present inventions are possible in the light of the above teachings. It is therefore to be understood that, within the scope of the appended claims, the invention may be practiced otherwise than specifically described.

Having thus described the invention, what is claimed as novel and desired to secure by Letter Patent is:

1. A security label for attaching to a garment formed from a first fabric material, the security label being detected when passed through a magnetic sensing field to produce a signal, said security label comprising:

a first portion formed from a second fabric material attached to said garment at a predetermined location on said first portion;

a security device attached to said first portion for interrupting said sensing field when said security device passes through said sensing field to produce said signal;

a cut line marking on said first portion located adjacent said predetermined location to provide an option for removing said security device from said garment at said cut line marking while at the retail store or after said garment has been removed from the retail store; and a second portion connected to said first portion, said second portion having garment information thereon including care instructions for said garment.

2. The security label according to claim 1 wherein said first portion includes two sections forming a pocket for receiving said security device.

3. The security label according to claim 2 wherein said two sections are heat sealed together for completely enclosing said security device.

4. The security label according to claim 2 wherein said two sections are formed by looping said second fabric material.

5. The security label according to claim 2 wherein said two sections consist of two different materials.

6. The security label according to claim 1 wherein said first portion includes a tab for attaching the security label to said first fabric material of said garment.

7. The security label according to claim 1 wherein said first portion includes two tabs for attaching the security label to said first fabric material of said garment by sewing through said two tabs.

8. The security label according to claim 1 wherein said first portion includes a tab and said second portion includes a tab for attaching the security label to said first fabric material of said garment.

9. The security label according to claim 1 wherein said second portion substantially covers said first portion, said second portion having a free end sewed with said first portion for attaching the security label to said garment to restrict access to said first portion.

10. A security label for attaching to a garment formed from a first fabric material, the security label being detected when passed through a magnetic sensing field to produce a signal, said security label comprising:

a strip of woven fabric material attached to said garment at a predetermined location on said strip;

a pocket woven in said strip;

a security device inserted in said pocket for interrupting said magnetic sensing field when said security device passes through said magnetic sensing field to produce said signal; and a cut line marking on said strip located adjacent said predetermined location to provide an option for removing said security device from said garment at said cut line marking while at the retail store or after said garment has been removed from the retail store;

said strip having garment information thereon including care instructions for said garment.

11. The security label according to claim 10 wherein said strip includes a tab for attaching the security label to said first fabric material of said garment.

12. The security label according to claim 10 wherein said pocket includes two woven layers, one of said layers having garment information thereon.

13. The security label according to claim 10 wherein said strip of woven fabric material is heated for sealing said pocket for completely enclosing said security device.

14. A security label for attaching to a garment formed from a first fabric material, the security label being detected when passed through a magnetic sensing field to produce a signal, said security label comprising:

a strip of a second fabric material;

a security device attached to said strip for interrupting said magnetic sensing field when said security device passes through said magnetic sensing field to produce said signal;

a tab connected to said strip for attaching said security label to said first fabric material of said garment at a predetermined location on said tab; and a cut line marking on said strip located adjacent said predetermined location to provide an option for removing said security device from said garment at said cut line marking while at the retail store or after said garment has been removed from the retail store.

15. The security device label according to claim 14 wherein said strip forms a pocket for receiving said security device.

16. The security label according to claim 15 wherein said pocket is heat sealed to completely enclose said security device.

17. The security label according to claim 14 wherein said tab is integrally formed from said strip.

18. A method of making a security label for attaching to a garment made from a first fabric material, the security label being detected when passed through a magnetic sensing field to produce a signal, said method comprises the steps of:

forming a pocket from a second fabric material;

placing a security device in said pocket for interrupting said magnetic sensing field when said security device passes through said magnetic sensing field to produce said signal;

heat sealing said pocket for completely enclosing said security device;

providing a tab for attaching said pocket to said first fabric material of said garment at a predetermined location; and placing a cut line marking on said second fabric material adjacent said predetermined location to provide an option for removing said security device from said garment at said cut line marking while at the retail store or after said garment has been removed from the retail store.

19. A method of making a security label for attaching to a garment made from a first fabric material, the security label being detected when passed through a magnetic sensing field to produce a signal, said method comprises the steps of:

folding a second fabric material a first time forming a pocket, said pocket includes a first layer and a second layer substantially parallel to said first layer;

placing a security device in said pocket for interrupting said magnetic field when said security device passes through said magnetic sensing field to produce said signal;

heat sealing said pocket for completely enclosing said security device;

folding said second material a second time to locate a third layer to substantially cover said second layer to permit sewing the security label to said first fabric material of the garment through said third layer, said second layer and said first layer, said third layer having garment information thereon including care instructions; and placing a cut line marking on said second fabric material to provide an option for removing said security device from said garment at said cut line marking while at the retail store or after said garment has been removed from the retail store.

* * * * *